US009651920B2

(12) United States Patent
Stranczl et al.

(10) Patent No.: US 9,651,920 B2
(45) Date of Patent: May 16, 2017

(54) MAGNETIC AND/OR ELECTROSTATIC RESONATOR

(71) Applicant: NIVAROX-FAR S.A., Le Locle (CH)

(72) Inventors: Marc Stranczl, Nyon (CH); Gianni Di Domenico, Neuchatel (CH); Pascal Winkler, St. Blaise (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/102,389

(22) PCT Filed: Dec. 9, 2014

(86) PCT No.: PCT/EP2014/076991

§ 371 (c)(1),
(2) Date: Jun. 7, 2016

(87) PCT Pub. No.: WO2015/096976

PCT Pub. Date: Jul. 2, 2015

(65) Prior Publication Data

US 2016/0313704 A1 Oct. 27, 2016

(30) Foreign Application Priority Data

Dec. 23, 2013 (CH) ..... 2140/13
Dec. 23, 2013 (CH) ..... 2141/13
(Continued)

(51) Int. Cl.
*G04C 5/00* (2006.01)
*G04B 15/14* (2006.01)

(52) U.S. Cl.
CPC ..... *G04C 5/005* (2013.01); *G04B 15/14* (2013.01)

(58) Field of Classification Search
CPC ..... G04C 5/005; G04C 3/064; G04C 3/06; G04C 3/105; G04B 15/14
See application file for complete search history.

(56) References Cited

U.S. PATENT DOCUMENTS 8,534,910 B2 * 9/2013 Baudet ..... G04C 3/047 368/126
8,794,823 B2 * 8/2014 Vardi ..... G04C 5/005 310/25
(Continued)

FOREIGN PATENT DOCUMENTS

BE 530 509 A 9/1957
FR 2 132 162 A1 11/1972

OTHER PUBLICATIONS

International Search Report issued Jul. 23, 2015, in PCT/EP2014/076991 filed Dec. 9, 2014.

*Primary Examiner* — Sean Kayes
(74) *Attorney, Agent, or Firm* — Oblon, McClelland, Maier & Neustadt, L.L.P.

(57) ABSTRACT

A timepiece resonator including a mobile component ring-shaped about an axis and capable of oscillation about an axis, and a drive member subjected to a torque inside a timepiece movement. The resonator is an annular magnetic or electrostatic resonator whose mobile component is periodically excited under action induced by motion of the drive member. The drive member can exert a contactless effort on the mobile component. The mobile component includes a first quantity of first pole pieces magnetically or electrically charged at a first pitch angle, and the drive member includes a second quantity of second pole pieces magnetically or electrically charged at a second pitch angle different from the first pitch angle, arranged to cooperate in attraction or in repulsion with the first pole pieces, such that the mobile component and the drive member together form a speed reducing or increasing mechanism.

21 Claims, 5 Drawing Sheets

(30) Foreign Application Priority Data

| | | |
|---|---|---|
| Dec. 23, 2013 | (EP) | 13199427 |
| Dec. 23, 2013 | (EP) | 13199428 |
| Jul. 11, 2014 | (CH) | 1057/14 |
| Jul. 11, 2014 | (EP) | 14176816 |
| Sep. 9, 2014 | (CH) | 1365/14 |
| Sep. 9, 2014 | (EP) | 14184158 |
| Sep. 19, 2014 | (CH) | 1416/14 |
| Sep. 19, 2014 | (EP) | 14185638 |
| Sep. 26, 2014 | (EP) | 14186652 |

(56) References Cited

U.S. PATENT DOCUMENTS

| | | | | |
|---|---|---|---|---|
| 9,030,070 | B2 * | 5/2015 | Marechal | F16C 32/0408<br>310/90.5 |
| 9,164,483 | B2 * | 10/2015 | Laesser | G04B 15/08 |
| 2015/0362892 | A1 * | 12/2015 | Zaugg | G04C 3/064<br>368/168 |

* cited by examiner

MAGNETIC AND/OR ELECTROSTATIC RESONATOR

CROSS-REFERENCE TO RELATED APPLICATIONS

This is a National phase application in the United States of International patent application PCT/EP2014/076991 filed Dec. 9, 2014 which claims priority on Swiss Patent Application No. 02140/13 of Dec. 23, 2013 - European Patent Application No. 13199427.9 of Dec. 23, 2013 - Swiss Patent Application No. 02141/13 of Dec 23, 2013 - European Patent Application No. 13199428.7 of Dec. 23, 2013 - Swiss Patent Application No. 01057/14 of Jul. 11, 2014 - European Patent Application No. 14176816.8 of Jul. 11, 2014 - Swiss Patent Application No. 01365/14 of Sep. 09, 2014 - European Patent Application No. 14184158.5 of Sep. 09, 2014 - Swiss Patent Application No. 01416/14 of Sep. 19, 2014 - European Patent Application No. 14185638.5 of Sep. 19, 2014 and European Patent Application No. 14186652.5 of Sep. 26, 2014. The entire disclosures of the above patent applications are hereby incorporated herein by reference.

FIELD OF THE INVENTION

The invention concerns a timepiece resonator comprising a mobile component ring-shaped about an axis and arranged to be capable of oscillation about an axis, and a drive member subjected to a torque inside a timepiece movement.

The invention also concerns a timepiece movement including, secured on a plate: an energy storage means arranged to deliver said torque to a gear train for actuating a mechanism including such an annular resonator, with a said mobile component secured by flexible strips to said plate, and a said drive member driven by said gear train, said drive member 8 controlling display means of said movement.

The invention also concerns a timepiece including one such movement.

The invention concerns the field of the regulation of mechanical timepieces, in particular mechanical watches.

BACKGROUND OF THE INVENTION

The numerous contacts in a regulating member impair the quality factor and efficiency. It is, moreover, difficult to reconcile the very different frequencies of the components of a resonator.

SUMMARY OF THE INVENTION

The invention proposes to create mechanisms exhibiting greater efficiency than conventional resonators.

To this end, the invention concerns a timepiece resonator comprising a mobile component ring-shaped about an axis and arranged to be capable of oscillation about an axis, and a drive member subjected to a torque inside a timepiece movement, characterized in that said resonator is a substantially annular magnetic or electrostatic resonator wherein said mobile component is periodically excited under the action induced by the motion of said drive member, said drive member is arranged to exert a contactless effort on said mobile component, said mobile component being flexible and deformable at least in a plane which is perpendicular to said axis and in which plane it oscillates, and said mobile component comprising a first area magnetically or electrically charged at a first pitch angle, and said drive member comprising a second area magnetically or electrically charged at a second pitch angle different from said first pitch angle, arranged to cooperate in attraction or in repulsion with said first area, such that said mobile component and said drive member together form a speed reducing or increasing mechanism, and the speed of said drive member either defines a speed of propagation of a wave of deformation in the material of said mobile component all round the mobile component, and may define a standing wave of oscillation of said mobile component between repetitive shapes corresponding to standing modes.

The invention also concerns a timepiece movement including, secured on a plate: an energy storage means arranged to deliver said torque to a gear train actuating a mechanism including such an annular resonator, with a said mobile component secured by flexible strips to said plate, and a said drive member driven by said gear train, said drive member controlling display means of said movement.

The invention also concerns a timepiece including such a movement, characterized in that said timepiece is a watch.

BRIEF DESCRIPTION OF THE DRAWINGS

Other features and advantages of the invention will appear upon reading the following detailed description, with reference to the annexed drawings, in which:

FIG. 1 shows a position wherein, at 12 o'clock and 6 o'clock, first pole pieces comprised in the ring-shaped mobile component and second pole pieces comprised in the drive member are aligned, and wherein, at 3 o'clock and 9 o'clock, the first pole pieces and the second pole pieces are not aligned. FIG. 2 shows a position where, after a small angular rotation of the drive member, the alignments are reversed.

FIG. 16 illustrates the particular resonant mode.

FIG. 18 illustrates the particular resonant mode.

Figure 19:
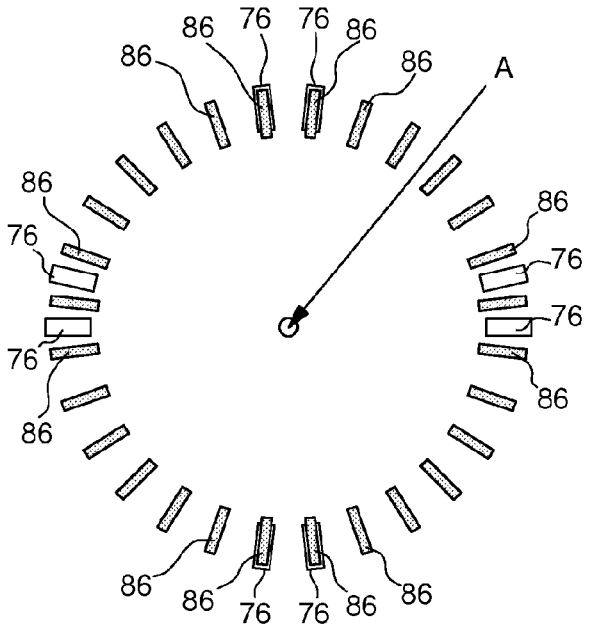
Figure 20:
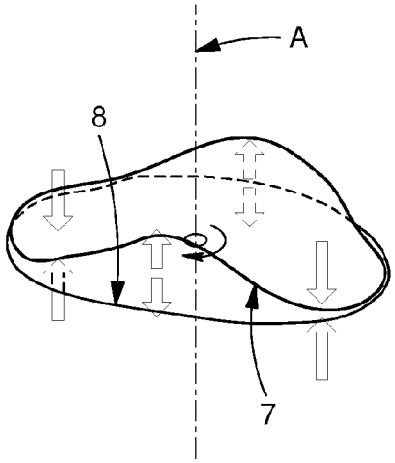

A third variant illustrated in FIG. 19 consists in stacking the drive member and the mobile component, oscillating in three dimensions, in FIG. 20.

Figure 21:
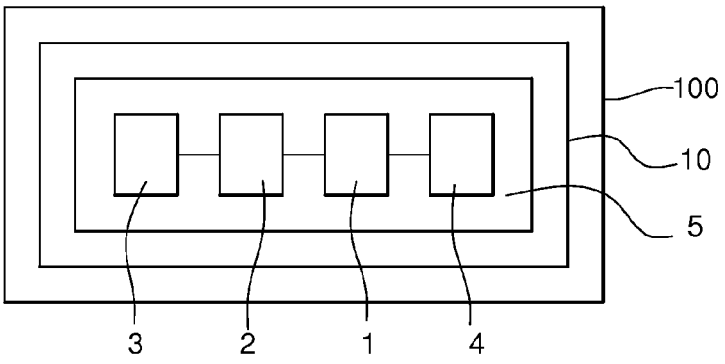

FIG. 21 is a block diagram illustrating a timepiece including a movement incorporating a mechanism according to the invention.

DETAILED DESCRIPTION OF PREFERRED EMBODIMENTS

Hereafter, a "ring" means a volume similar to an open torus, extending, closed on itself, about an axis. This 'ring' is substantially a surface of revolution about the axis, but not necessarily exactly of revolution about the axis.

The invention may be implemented with the involvement of magnetic and/or electrostatic fields. It is more particularly illustrated in a magnetic variant.

The invention concerns a timepiece resonator 6, comprising a mobile component 7 arranged to be capable of oscillation about an axis A, and a drive member 8 subjected to a torque inside a timepiece movement 10.

According to the invention, this resonator is a substantially annular magnetic or electrostatic resonator 6, whose mobile component 7 is periodically excited under the action induced by the motion of drive member 8; said drive member 8 is arranged to exert a contactless effort on mobile component 7.

Mobile component set 7 is flexible and deformable at least in a plane perpendicular to axis A, and mobile component 7 comprises a first area magnetically or electrically charged at a first pitch angle, and drive member 8 includes a second area magnetically or electrically charged at a second pitch angle different from said first pitch angle, arranged to cooperate in attraction or in repulsion with said first area, so that mobile component 7 and drive member 8 together form a speed reducing or increasing mechanism.

The interaction may occur between a magnetically or respectively electrically charged element, and a conductive or respectively dielectric track.

More specifically, in a non-limiting embodiment illustrated by the Figures, mobile component 7 includes a first quantity of first pole pieces 76 magnetically or electrically charged at a first pitch angle and drive member 8 includes a second quantity of second pole pieces 86 magnetically or electrically charged at a second pitch angle which is different from the first pitch angle. These second pole pieces 86 are arranged to cooperate in attraction or in repulsion with first pole pieces 76, such that mobile component 7 and drive member 8 together form a speed reducing or increasing mechanism.

More specifically, the first quantity differs from the second quantity.

More specifically, the first quantity differs from the second quantity by one unit.

In particular, the speed of drive member 8 defines a speed of propagation of a deformation wave in the material of mobile component 7 all around the latter.

In another implementation of the invention, the speed of drive member 8 defines a standing wave of oscillation of mobile component 7 between repetitive shapes corresponding to standing modes.

Preferably, the movement of drive member 8 includes at least one pivoting motion.

More specifically, and as illustrated in a non-limiting manner by the Figures, the movement of drive member 8 is a pivoting motion about axis A.

Figure 15:
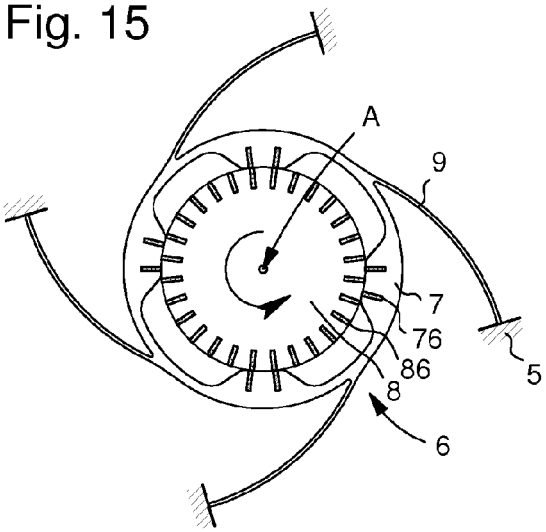
FIGS. 15 and 16 illustrate a first variant of the invention, which consists in exciting a mobile component in the form of a partial ring according to FIG. 12.
Figure 17:
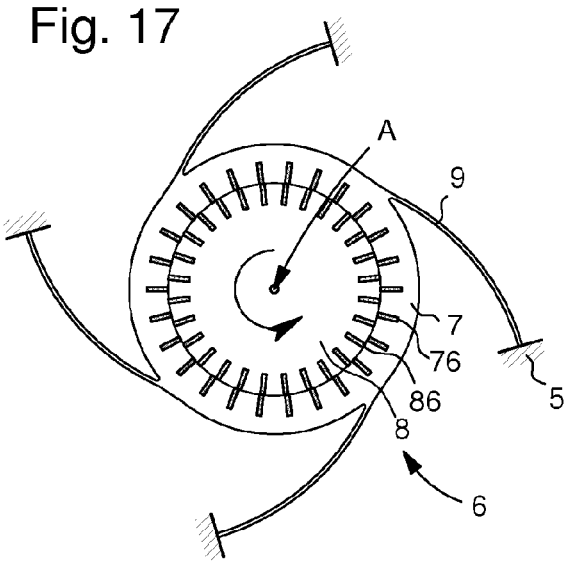
FIGS. 17 and 18 illustrate a second variant, which consists in exciting a mobile component in the form of a complete ring.

In a specific embodiment, as seen in FIGS. 15 and 17, mobile component 7 is fixed to a plate 5 comprised in timepiece movement 10 via a plurality of flexible strips 9.

In a first variant, these flexible strips 9 are more flexible than mobile component 7, arranged to maintain mobile component 7 substantially centered on axis A, and to restrict the movements of oscillation of mobile component 7 in the same plane P perpendicular to said axis A with limited displacements of the centre of inertia of mobile component 7, less than one tenth of the smallest external dimension of mobile component 7 in plane P.

In a second variant, these flexible strips 9 are stiffer than mobile component 7, arranged to maintain mobile component 7 substantially centered on axis A, and to restrict the movements of mobile component 7 in the same plane P perpendicular to said axis A with limited displacements of the centre of inertia of mobile component 7, less than one tenth of the smallest external dimension of mobile component 7 in plane P.

More particularly, mobile component 7 is weighted on its periphery in a continuous or periodic manner.

In particular, mobile component 7 is weighted by a plurality of inertia-blocks.

In particular, mobile component 7 has variable sections and/or thicknesses around its periphery.

Advantageously mobile component 7 is made of micromachinable material or silicon and has a rectangular section in every plane passing through said axis A Advantageously, mobile component 7 is integral with a plurality of flexible strips 9 for connection to a plate 5 comprised in timepiece movement 10.

Advantageously, mobile component 7 is integral with the plurality of flexible strips 9 and with plate 5.

In a particular embodiment, in an unstressed free state, mobile component 7 has a polygonal or polylobate shape in a plane P orthogonal to axis A.

In a particular embodiment illustrated in FIGS. 1 to 19, mobile component 7 is a ring coaxial to drive member 8.

In a particular embodiment, as seen in FIG. 20, mobile component 7 is a solid at least partially deformable in the direction of axis A.

The invention also concerns a timepiece movement 10 including, secured on a plate 5, an energy storage means 3, notably a barrel, arranged to deliver torque to a gear train 2 for actuating a mechanism 1 comprising such an annular resonator 6, with such a mobile component 7 secured by flexible strips 9 to plate 5, and a drive member 8, notably an escape wheel, driven by gear train 2, drive member 8 preferably controlling display means 4 of movement 10.

The invention also concerns a timepiece 100 including such a movement 10. Preferably, this timepiece 100 is a watch.

More specifically, the Figures illustrate advantageous variant embodiments.

Mobile component 7 includes first pole pieces 76, and drive member 8 includes second pole pieces 86. The number of pole pieces on each structure is selected such that, for a given angle of drive member 8, the pole pieces at 12 o'clock and 6 o'clock of mobile component 7 and of drive member 8 are facing each other and the pole pieces at 3 o'clock and 9 o'clock are not facing each other. With a small rotation of angle e of drive member 8, the alignments are reversed.

Figure 1:
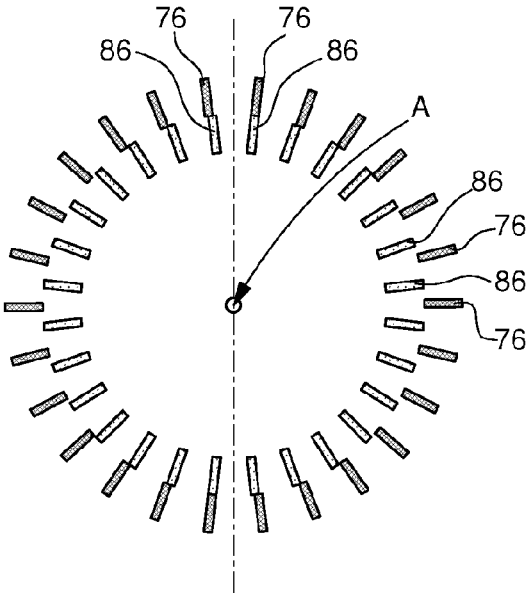
FIGS. 1 and 2 show schematic plan views of an annular resonator according to the invention, with a mobile component in the form of a ring which is excited by a drive member in the form of a wheel.
Figure 2:
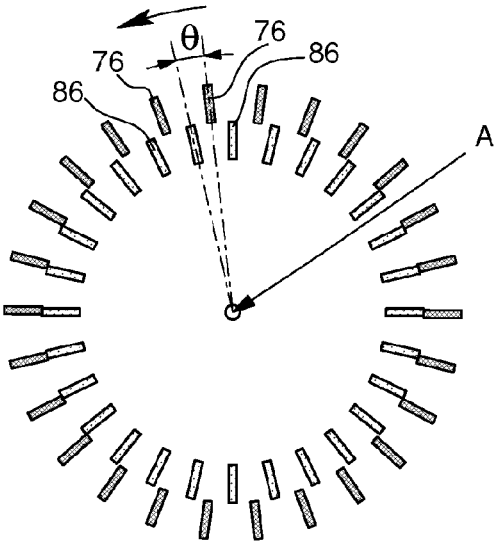

In FIG. 1, at 12 o'clock and 6 o'clock, the first pole pieces 76 and second pole pieces 86 are aligned. At 3 o'clock and 9 o'clock, first pole pieces 76 and second pole pieces 86 are not aligned. In FIG. 2, with a small rotation of angle θ of drive member 8, the alignments are reversed.

Figure 4:
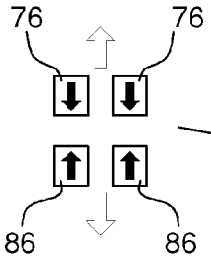
Figure 3:
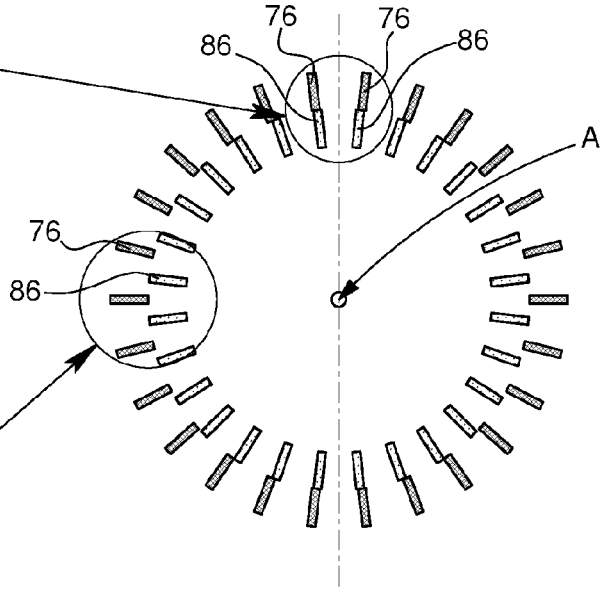
FIG. 3 illustrates a similar embodiment wherein the pole pieces are made with magnets, and wherein, in FIG. 4, when the pole pieces are aligned, they repel each other, and in FIG. 5, when the pole pieces are out of alignment, they attract each other.
Figure 5:
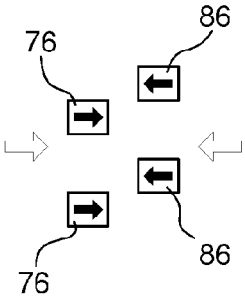

In FIG. 3, the pole pieces are made with magnets: Drive member 8 is biased radially outwardly and mobile component 7 is biased radially towards axis A. In FIG. 4, when the pole pieces are aligned, they repel each other. In FIG. 5, when the pole pieces are out of alignment, they attract each other.

Figure 7:
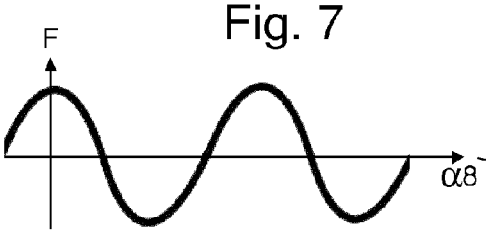
FIGS. 6 and 7 show a diagram of the interaction effort between the mobile component and the drive member, as a function of the angle of the drive member, corresponding to FIG. 6, at 12 o'clock in FIG. 7, and at 9 o'clock in FIG. 8.
Figure 6:
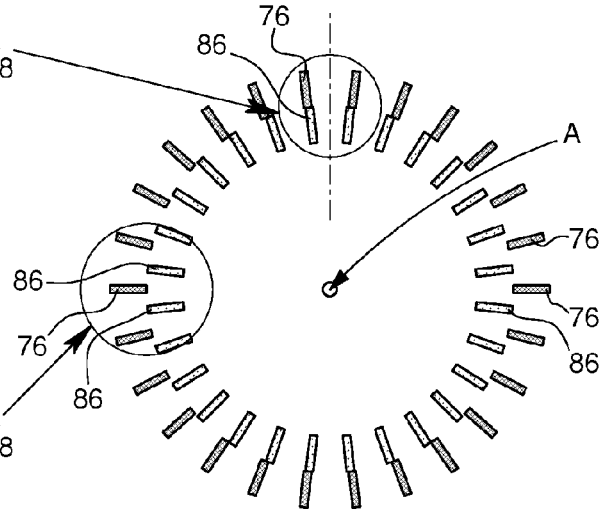
Figure 8:
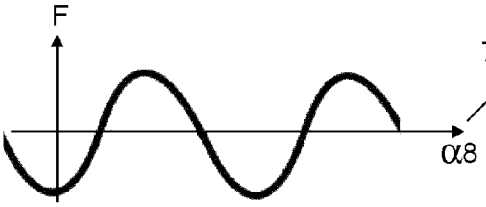

The interaction effort diagram can thus be drawn as a function of the angle of drive member 8, corresponding to FIG. 6, between mobile component 7 and drive member 8, at 12 o'clock in FIG. 7, and at 9 o'clock in FIG. 8.

Figure 10:
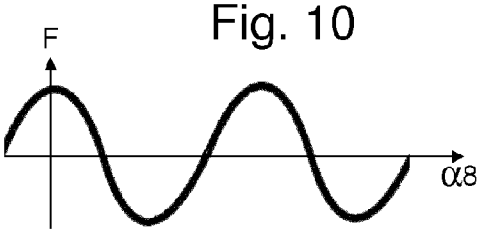
FIGS. 9 to 11 are similar to FIGS. 6 to 8, with some pole pieces removed from the mobile component, the remaining pole piece groups being positioned periodically on the periphery.
Figure 9:
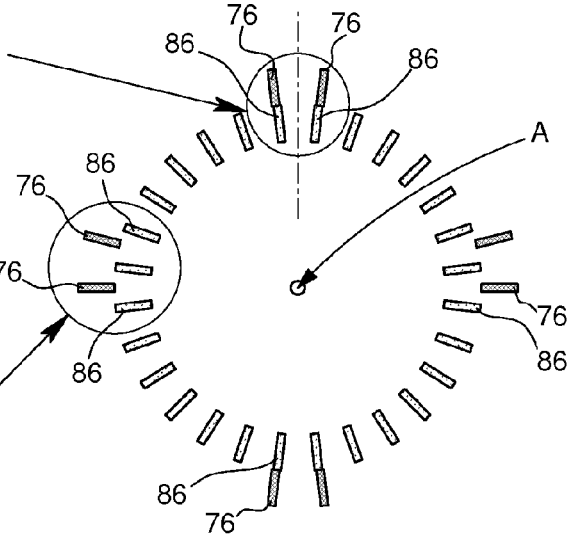
Figure 11:
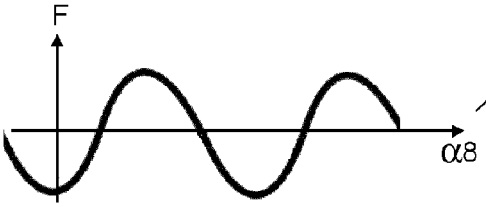
Figure 13:
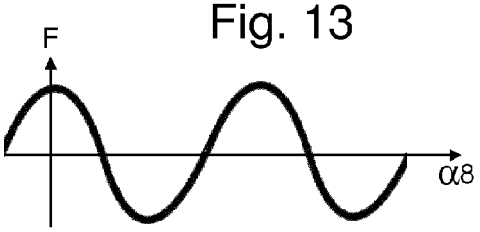
FIGS. 12 to 14 are also similar to FIGS. 6 to 8, and retain only four pairs of first pole pieces on the mobile component, at 90° from each other.
Figure 12:
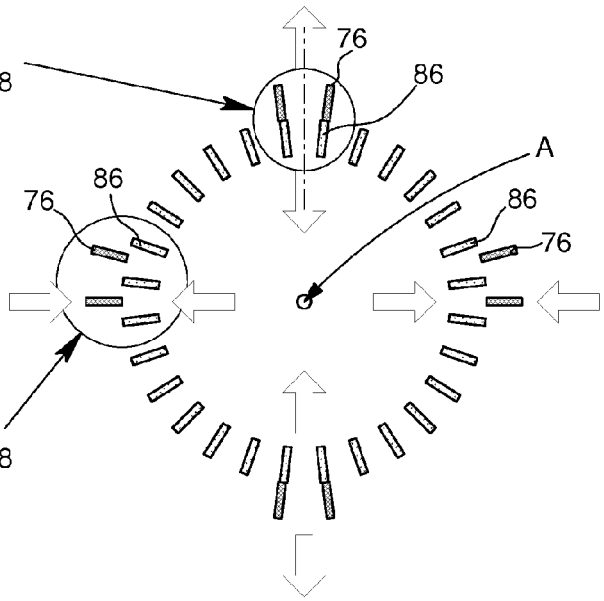
Figure 14:
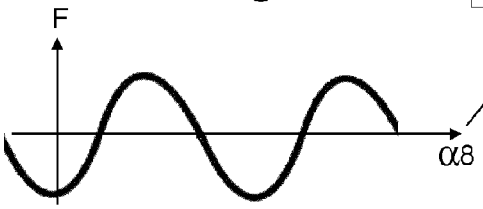

FIGS. 9 to 11, similar to FIGS. 6 to 8, show that, by removing pole pieces from mobile component 7, it is possible to select where it is desired to locate the interaction efforts between the two elements. FIGS. 12 to 14 go further by retaining only four pairs of first pole pieces 76 on mobile component 7, at 90° from each other.

Figure 16:
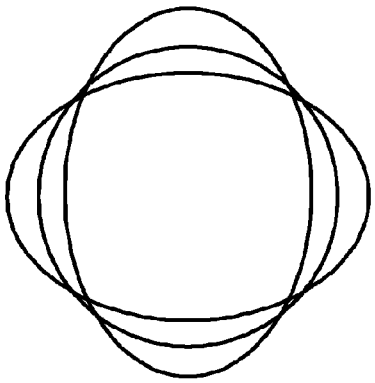

FIGS. 15 and 16 illustrate a first variant of the invention, which consists in using the principle described above to excite a mobile component 7 in the form of a partial ring, so that it resonates in so-called wine glass mode: drive member 8 synchronises with the oscillations of mobile component 7. There is no mechanical interaction between drive member 8 and mobile component 7.

FIG. 15 is a diagram of the mechanism, wherein ring-shaped mobile component 7 is only excited at 12 o'clock, 3 o'clock, 6 o'clock and 9 o'clock. FIG. 16 illustrates its resonant mode in variable eccentric ellipses with permutation of axes.

Figure 15A:
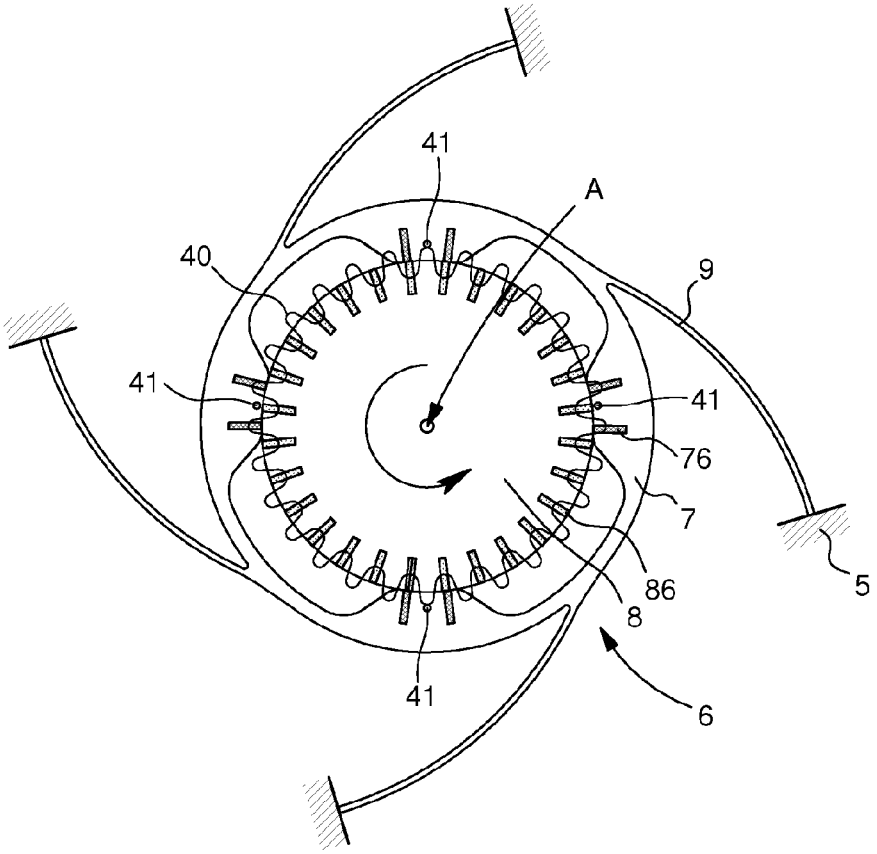
FIG. 15A is a variant of the embodiment of FIG. 15, comprising loss of synchronization limiting means in the form of mechanical stops.

FIG. 15A is a variant embodiment of FIG. 15, comprising loss of synchronization limiting means in the form of mechanical stops. On a second level, parallel to that of pole pieces 86 of drive member 8, a toothed wheel 40 is integral with drive member 8, and mobile component 7 comprises stops in the form of pins 41. In normal operation, these pins 41 oscillate with mobile component 7, without touching toothed wheel 40. In the event of loss of synchronization, drive member disc 8 tends to race and rotate too fast, but pins 41 then collide with toothed wheel 40, which prevents racing.

Figure 18:
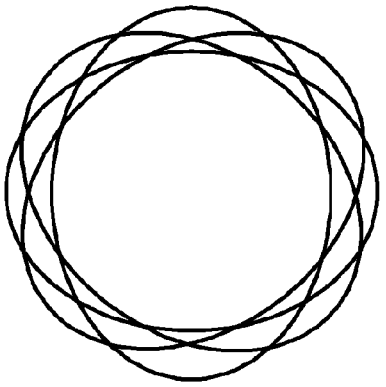

FIGS. 17 and 18 illustrate a second variant, which consists in using the principle described above with a mobile component 7 in the form of a complete ring, for excitation in so-called hula-hoop mode. FIG. 17 is a diagram of the mechanism, wherein ring-shaped mobile component 7 is excited over its entire circumference. FIG. 18 illustrates its particular resonant mode.

A third variant illustrated in FIG. 19 consists in stacking drive member 8 and mobile component 7, in order to make mobile component 7 oscillate in three dimensions, at least partially in the direction of axis A, in height, according to the same principle as the first variant. The disc is thus potato-chip shaped, as seen in FIG. 20.

A fourth variant (not illustrated) is the out-of-plane version of the second variant very close to the third variant.

Another variant, not illustrated, includes a drive member 8 which, instead of individual magnets, includes a track which interacts with magnets on vibrating mobile component 7, in the same manner as magnet-to-magnet cooperation.

The invention makes it possible to remove contacts in the regulating member, resulting in an improved quality factor, and increasing efficiency. Moreover, drive member 8, preferably formed by an escape wheel, rotates at a low frequency and mobile component 7, preferably a ring, resonates at a high frequency.

The embodiment of FIG. 15, with a mobile component 7 as an incomplete ring, reduced to certain angular ranges, makes it possible to effort vibration in wineglass mode.

The invention claimed is:

1. A timepiece resonator comprising:

a mobile component ring-shaped about an axis and capable of oscillation; and a drive member subjected to a torque inside a timepiece movement;

wherein the resonator is a substantially annular magnetic or electrostatic resonator;

wherein the mobile component is periodically excited under action induced by movement of the drive member, the drive member is arranged to exert a contactless effort on the mobile component, the mobile component being flexible and deformable in a plane perpendicular to the axis and in which the mobile component oscillates;

the mobile component comprising a first area magnetically or electrically charged at a first pitch angle, and the drive member comprising a second area magnetically or electrically charged at a second pitch angle different from the first pitch angle, arranged to cooperate in attraction or in repulsion with the first area, such that the mobile component and the drive member together form a speed reducing or increasing mechanism; and wherein speed of the drive member defines a speed of propagation of a wave of deformation in a material of the mobile component all round the mobile component, or defines a standing wave of oscillation of the mobile component between repetitive shapes corresponding to standing modes.

2. The timepiece resonator according to claim 1, wherein the mobile component includes a first quantity of first pole pieces magnetically or electrically charged at a first pitch angle, and wherein the drive member comprises a second quantity of second pole pieces magnetically or electrically charged at a second pitch angle different from the first pitch angle, arranged to cooperate in attraction or in repulsion with the first pole pieces, such that the mobile component and the drive member together form a speed reducing or increasing mechanism.

3. The timepiece resonator according to claim 2, wherein the drive member includes, on a second level, parallel to that of the second pole pieces, a toothed wheel integral with the drive member, and wherein the mobile component includes stops in a form of pins which, in normal operation, oscillate with the mobile component without touching the toothed wheel, and hook the toothed wheel in event of loss of synchronization, to prevent racing.

4. The timepiece resonator according to claim 2, wherein the first quantity differs from the second quantity.

5. The timepiece resonator according to claim 4, wherein the first quantity differs from the second quantity by one unit.

6. The timepiece resonator according to claim 1, wherein the speed of the drive member defines a standing wave of oscillation of the mobile component between repetitive shapes corresponding to standing modes.

7. The timepiece resonator according to claim 1, wherein the movement of the drive member includes at least one pivoting motion.

8. The timepiece resonator according to claim 7, wherein the movement of the drive member is a pivoting motion about the axis.

9. The timepiece resonator according to claim 1, wherein the mobile component is secured to a plate included in the timepiece movement by a plurality of flexible strips, more flexible than the mobile component, arranged to maintain the mobile component substantially centered on the axis, and to restrict motions of the mobile component in a same plan perpendicular to the axis with limited displacements of the center of inertia of the mobile component less than one tenth of a smallest external dimension of the mobile component in the plane.

10. The timepiece resonator according to claim 1, wherein the mobile component is secured to a plate included in the timepiece movement by a plurality of flexible strips, more rigid than the mobile component, arranged to maintain the mobile component substantially centered on the axis, and to restrict motions of the mobile component in a same plan perpendicular to the axis with limited displacements of the center of inertia of the mobile component less than one tenth of a smallest external dimension of the mobile component in the plane.

11. The timepiece resonator according to claim 1, wherein the mobile component is weighted on a periphery thereof, in a continuous or periodic manner.

12. The timepiece resonator according to claim 11, wherein the mobile component is weighted by a plurality of inertia-blocks.

13. The timepiece resonator according to claim 1, wherein the mobile component includes variable sections and/or thicknesses along a periphery thereof.

14. The timepiece resonator according to claim 1, wherein the mobile component is made of micromachinable material or silicon and includes a rectangular section in every plane passing through the axis.

15. The timepiece resonator according to claim 14, wherein the mobile component is made integral with a plurality of flexible strips for connection to a plate included in the timepiece movement.

16. The timepiece resonator according to claim 15, wherein the mobile component is integral with the plurality of flexible strips and with the plate.

17. The timepiece resonator according to claim 1, wherein, in an unrestricted free state, the mobile component has a polygonal or polylobate shape in a plane orthogonal to the axis.

18. The timepiece resonator according to claim 1, wherein the mobile component is a ring coaxial to the drive member.

19. The timepiece resonator according to claim 1, wherein the drive member is an escape wheel.

20. A timepiece movement comprising, secured on a plate, an energy storage means to deliver torque to a gear train for actuating a mechanism including an annular resonator according to claim 1, with the mobile component is secured by flexible strips to the plate, the drive member is driven by the gear train, and the drive member controls a display means of the movement.

21. A timepiece comprising a movement according to claim 20, wherein the timepiece is a watch.

* * * * *